US008441335B2

(12) United States Patent
Downey et al.

(10) Patent No.: US 8,441,335 B2
(45) Date of Patent: May 14, 2013

(54) METHOD OF TRIMMING A THIN FILM RESISTOR, AND AN INTEGRATED CIRCUIT INCLUDING TRIMMABLE THIN FILM RESISTORS

(75) Inventors: Fergus John Downey, Coolree (IE); Bernard Patrick Stenson, Ballcahane (IE); James Michael Molyneaux, Camheen (IE)

(73) Assignee: Analog Devices, Inc., Norwood, MA (US)

( * ) Notice: Subject to any disclaimer, the term of this patent is extended or adjusted under 35 U.S.C. 154(b) by 216 days.

(21) Appl. No.: 12/909,663

(22) Filed: Oct. 21, 2010

(65) Prior Publication Data

US 2012/0098593 A1 Apr. 26, 2012

(51) Int. Cl.
*H01C 10/00* (2006.01)

(52) U.S. Cl.
USPC ..... 338/79; 338/195; 29/610.1

(58) Field of Classification Search ..... 338/195
See application file for complete search history.

(56) References Cited

U.S. PATENT DOCUMENTS

| | | | | |
|---|---|---|---|---|
| 3,603,768 | A | 9/1971 | Ireland et al. | |
| 4,210,996 | A | 7/1980 | Amemiya et al. | |
| 4,467,312 | A * | 8/1984 | Komatsu | 338/309 |
| 4,505,032 | A | 3/1985 | Praria | |
| 4,606,781 | A * | 8/1986 | Vyne | 438/10 |
| 4,713,680 | A * | 12/1987 | Davis et al. | 257/536 |
| 5,015,989 | A | 5/1991 | Wohlfarth et al. | |
| 5,635,893 | A | 6/1997 | Spraggins et al. | |
| 6,246,243 | B1 | 6/2001 | Audy | |
| 6,636,143 | B1 | 10/2003 | Hashimoto et al. | |
| 7,084,691 | B2 * | 8/2006 | Hsu | 327/308 |
| 7,119,656 | B2 | 10/2006 | Landsberger et al. | |
| 7,154,370 | B2 | 12/2006 | Szwarc et al. | |
| 7,239,006 | B2 * | 7/2007 | Coolbaugh et al. | 257/537 |
| 7,598,841 | B2 * | 10/2009 | McGuinness et al. | 338/195 |
| 7,719,403 | B2 | 5/2010 | McGuinness et al. | |
| 2005/0001241 | A1 | 1/2005 | Doyle | |
| 2006/0028894 | A1 | 2/2006 | Brennan et al. | |

FOREIGN PATENT DOCUMENTS

| | | |
|---|---|---|
| EP | 0 033 155 | 1/1981 |
| JP | 06-084621 | 3/1994 |
| SU | 834784 | 5/1981 |
| SU | 1092576 A | 5/1984 |
| WO | WO 86/02492 | 4/1986 |
| WO | WO 91/13448 | 5/1991 |
| WO | WO 2005/004207 | 1/2005 |

OTHER PUBLICATIONS

Feldbaumer et al., "Pulse Current Trimming of Polysilicon Resistors." Transactions on Electron Devices, vol. 42, No. 4, Apr. 1995. pp. 689-695.*

(Continued)

*Primary Examiner* — Kyung Lee
(74) *Attorney, Agent, or Firm* — Knobbe Martens Olson & Bear LLP

(57) ABSTRACT

Apparatus and methods of trimming resistors are disclosed. In one embodiment, a method of controlling the PCR of a thin film resistor is provided. The method includes applying a first current to a resistor so as to alter a property of the resistor, and measuring the property of the resistor. Applying the first current and measuring the property of the resistor can be repeated until the PCR of the resistor is within an acceptable tolerance of a desired value for the property of the resistor.

19 Claims, 6 Drawing Sheets

OTHER PUBLICATIONS

U.S. Appl. No. 13/553,894, filed Jul. 20, 2012, titled "Method for Altering Electrical and Thermal Properties of Resistive Materials", in 16 pages.

International Search Report and Written Opinion of related application PCT/US2011/056909 dated Jan. 31, 2012.

Written Opinion of the International Preliminary Examining Authority in PCT Appl. No. PCT/US2011/056909, dated Dec. 20, 2012, 13 pages.

* cited by examiner

METHOD OF TRIMMING A THIN FILM RESISTOR, AND AN INTEGRATED CIRCUIT INCLUDING TRIMMABLE THIN FILM RESISTORS

BACKGROUND

1. Field of the Invention

The present invention relates to a method of trimming thin film resistors, and to integrated circuits including the same.

2. Background of the Invention

Resistors can be fabricated within integrated circuits. Although resistors on a single integrated circuit may be matched with respect to each other, process variations within the fabrication process can result in the resistances of the resistors varying by significant amounts between integrated circuits or between design targets and fabricated values, such as a variation of up to about 20%. To calibrate such integrated resistors, which are normally provided as thin film resistors, methods such as a laser trimming and provision of additional resistors with fusible links can be used. Laser trimming has been successful in obtaining the degree of calibration required, but can only be carried out prior to assembly of the integrated circuit in a package. Laser trimming cannot be used to modify the power coefficient of resistance ("PCR") of a resistor.

Fusible link trimming can be used to provide additional resistors that are fabricated in association with respective fusible links, which can be in series or parallel with a resistor, and which can be selectively blown by application of a relatively large current to trim out resistor values to a desired value. Semi-fusible links can be provided, which in their "blown" state have a higher resistance value but are not open circuit. Such links are often associated with active programming circuitry in order that they can be selected for blowing. However these techniques do not allow the PCR of the resistor to be controlled.

The PCR is the change in resistance value as a function of the power dissipated by the resistor. The dissipated power can be determined by the product of the current through the resistor and the voltage across it. There is a need for a method of trimming resistors which can be used to control or modify the PCR of the resistors.

SUMMARY

According to a first aspect of the present invention there is provided a method of trimming a thin film resistor, comprising the steps of a) applying a first current to a resistor so as to alter a power coefficient of resistance ("PCR") of the resistor;

b) measuring the PCR of the resistor;

and optionally repeating steps a) and b) until the PCR of the resistor is within an acceptable tolerance of a desired value.

According to a second aspect of the present invention there is provided an integrated circuit including at least one resistor, and including connection paths to the resistor to enable the resistor to be trimmed in accordance with the method described above.

According to a third aspect of the present invention, a method of adjusting a PCR of a resistor is disclosed. The method includes providing a current through the resistor and heating the resistor by increasing a magnitude of the current from a first magnitude to a second magnitude. The second magnitude is selected to induce thermal migration in the resistor so as to adjust the PCR of the resistor.

According to a fourth aspect of the present invention, a method of adjusting a resistor is disclosed. The method includes applying a current to the resistor so as to alter a resistance of the resistor as a function of an operational parameter and measuring an electrical characteristic indicative of the resistance of the resistor as a function of the operation parameter.

BRIEF DESCRIPTION OF THE DRAWINGS

The present invention will further be described, by way of non-limiting example only, with reference to the accompanying Figures, in which.

DETAILED DESCRIPTION OF EMBODIMENTS

Figure 1:
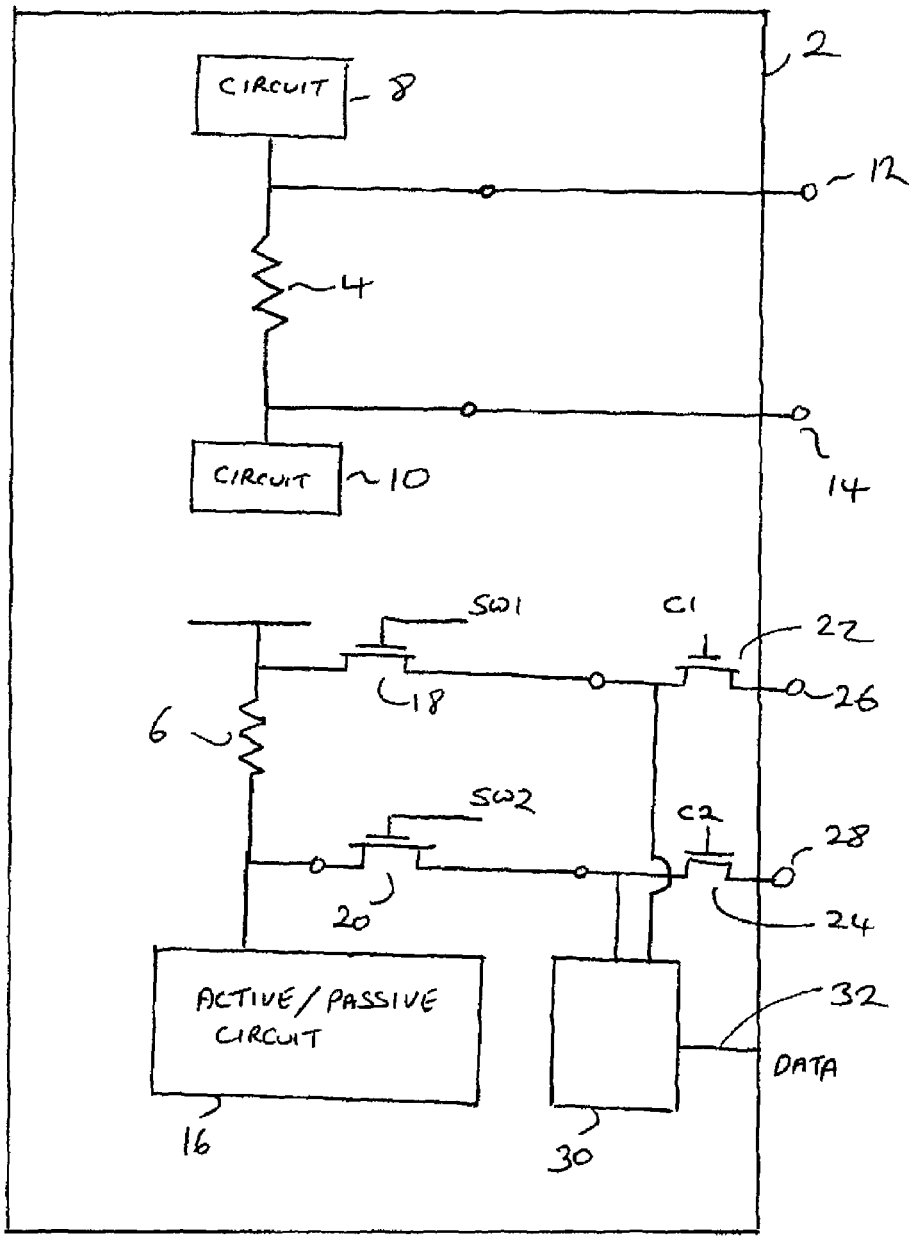
FIG. 1 schematically illustrates an integrated circuit having first and second trimmable resistors.

FIG. 1 schematically illustrates an integrated circuit, generally designated 2, in which first and second thin film resistors 4 and 6 have been fabricated. The resistor 4 is illustrated as being interposed between circuit elements 8 and 10 (whose function is unimportant to this discussion) but is also connected to external pins 12 and 14. Current can be supplied to the resistor 4 via pins 12 and 14 in order to modify its parameters, such as the resistance and power coefficient of resistance (PCR), as will be described in further detail below. Additionally, the pins 12 and 14 can be used to measure the resistance or other characteristics of the resistor. In some embodiments of the invention pins 12 and 14 can be positioned so that the resistance is trimmed and the PCR is controlled between two desired points. By contrast, resistor 6 is connected to a circuit 16 but has no direct connection to external pins. In order to modify the resistor 6, additional switches 18, 20, 22 and 24 are provided. By making the switches 18, 20, 22 and 24 relatively low impedance, the resistor 6 can be placed in electrical contact with pins 26 and 28. Pins 26 and 28 may serve additional functions and a control circuit (not shown) within the integrated circuit 2 can be used to ensure that switches 22 and 24 are only placed in the low impedance state during a specific trimming mode. Alternatively, current supply to the resistor 6 and measurement of voltage or any other suitable parameter across the resistor 6 may be performed via a programming module 30 fabricated within the integrated circuit 2. The programming module 30 may include a digitally controllable current source and an analog to digital converter operable to selectively control the current supplied to the resistor 6 and to measure the voltage across it. Interaction between the programming module 30 and modules external to the integrated circuit 2 can be made via databus 32. In such an arrangement, the programming module 30 can control the states of the switches 18 and 20 via signals SW1 and SW2 and, if transistors 22 and 24 are provided, can also control their states via signals C1 and C2 such that transistors can be selectively low impedance or high impedance. The programming module may be associated with an array of resistors of which the resistor 6 only represents a single instance.

Silicon chromium can be used as a resistive material to form thin film resistors and fuses during integrated circuit fabrication. Silicon chromium fuses can be blown by applying a relatively large current which heats up the silicon chromium film to introduce mechanical breakdown in the film. This mechanical breakdown results in a high resistance or open circuit. However, the inventors have noticed that prior to this breakdown occurring, the heat causes thermal migration of the silicon away from the center of the silicon chromium film. This silicon migration can result in areas of a chromium dominant film which reduces the absolute resistance, increases the power coefficient of resistance (PCR), and improves the thermal conductivity of the film. As will be described in detail below, electrically induced Joule heating or ohmic heating of silicon chromium resistors can be used to induce silicon migration so as to tailor the electrical properties of the resistors. For example, a current can be applied to the resistor so as to alter a resistance of the resistor as a function of an operational parameter, such as power, current, voltage or temperature.

Figure 2:
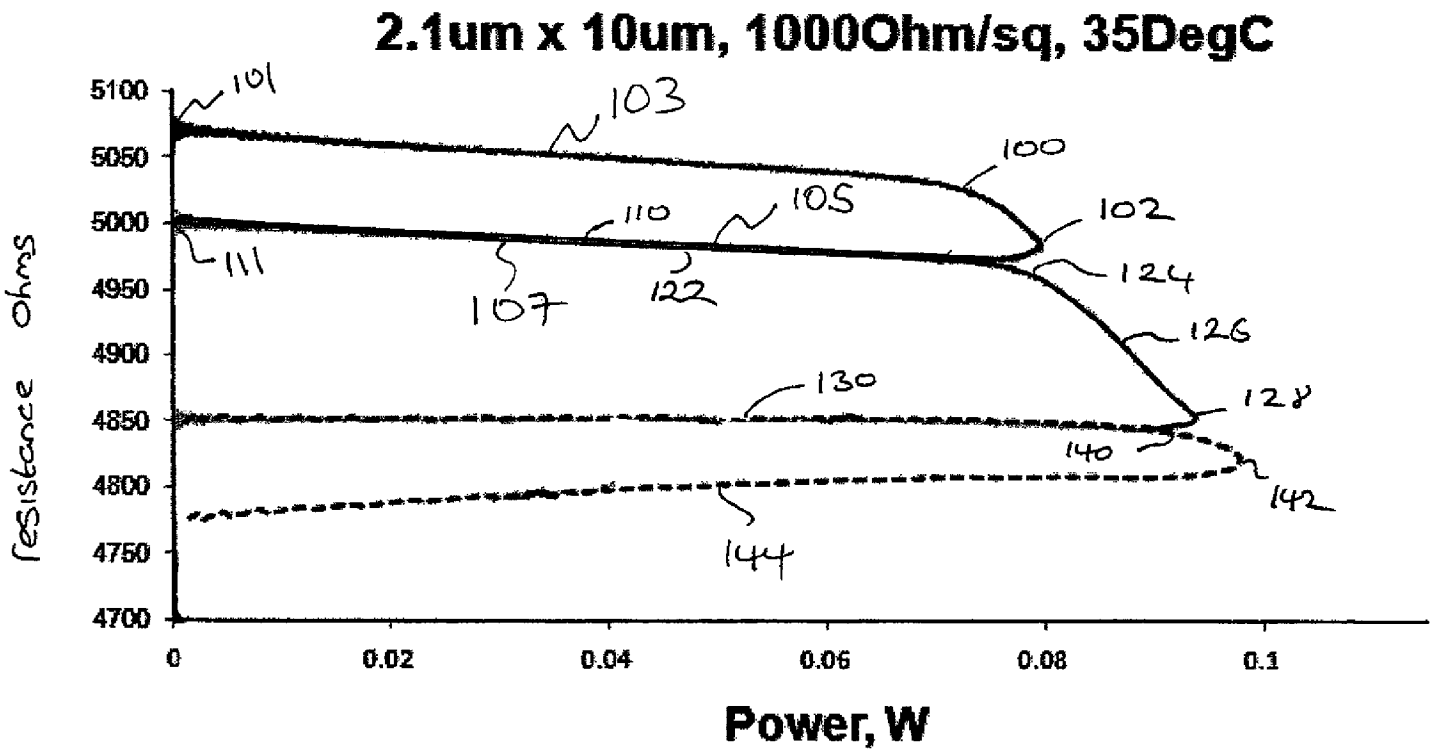
FIG. 2 is a graph showing resistance as a function of power for current swept upwardly and downwardly in magnitude over various sweeps.

FIG. 2 illustrates test results from a silicon chromium thin film resistor. In this example the thin film resistor has a width of about 2.1 microns and a length of about 10 microns, manufactured such that each square of approximately 1 micron by 1 micron has a notional resistance of about 1,000 ohms. The abscissa shows the resistance in ohms whereas the ordinate shows the amount of power dissipated in the resistor in Watts as a current in the resistor is varied.

Initially we start at a point 101 with substantially no power being dissipated in the resistor, and a measurement of the voltage across the resistor and the current flowing through it enables us to determine that the resistor is fabricated with a resistance of approximately 5075 ohms. The current through the resistor can then be swept upwardly from the start point 101, which in this example corresponds to about zero milliamps, to an end value 102. This can be regarded as being a "thermal stressing sweep". Current passing through the resistor causes the resistor to heat up. Since the thermal coefficient of resistance of silicon chromium is negative, at approximately −20 parts per million per degree C., heating up the resistor causes the resistance to drop. The resistance continues to drop substantially linearly between the start point 101 and the region generally designated 100, after which the rate of change of resistance with increasing power dissipation becomes more negative. It can be seen that the region 100 corresponds to a resistance of about 5030 ohms and dissipation of about 0.072 watts, which from Ohm's Law corresponds to a current flowing through the resistor of approximately 3.8 milliamps. In this example the current is increased further to a first pass end value which is designated by turning point or end value 102 in FIG. 2 and corresponds to a value of substantially 4 milliamps. Thermal migration of the silicon occurs in the resistor between the region 100 and the end value 102. In this first current sweep 103 the current was swept upwardly from zero milliamps to substantially 4 milliamps. Following this first current sweep 103 to thermally stress the resistor, the electrical properties of the resistor are measured during a first measurement phase 105. Conveniently the first measurement phase 105 is performed by sweeping the current downwardly from a first measurement value to a second measurement value. This can be regarded as being a "measurement sweep". The measurement phase can include measuring an electrical characteristic indicative of the resistance of the resistor as a function of an operation parameter, particularly one related to temperature, including, for example, power, current, voltage or temperature. For example, the measurement phase can include measuring a current through a resistor and/or a voltage across the resistor to determine the PCR or TCR of the resistor.

In this instance the first, measurement value corresponds to the end value 102 of the first current sweep 103 and the measurement current end value corresponds to the start value 101 of about zero amps. Thus the current follows a trajectory designated 110 which causes the amount of power in the resistor to reduce with the evolution of time and a plurality of measurements of the voltage across the resistor and the current flowing in it are made such that the resistance is determined, and can be tracked as the power dissipated in the resistor reduces. It can be seen that, following this first sweep 103 the resistance of the resistor at room temperature i.e. when not dissipating any power, is substantially 5000 ohms.

It should be noted that measurements of resistance as a function of power (or current) can be made whilst the magnitude of the current is being increased.

As will be described in further detail below with respect to FIGS. 3-5, at the end of the first sweep the power coefficient of resistance (PCR) and the temperature coefficient of resistance has changed after the first sweep 103. The power coefficient of resistance is equal to the slope of the sweep 103, and can be measured in Ohms per Watt. The slope of the forward sweep 103 is the PCR of the resistor in its initial state while the slope of the measurement sweep 105 is the PCR of the resistor after a first trim.

Following a completion of a first thermal stressing 103 and measurement cycle 105, a second thermal stressing or current sweep 107 and second measurement cycle 130 was commenced. Thus, the first current was increased in a second current sweep 107 from about zero amps to a second sweep end value 128. In this second sweep 107 the maximum current was selected to be incrementally higher than the first end value 102, in this example 4.35 milliamps. Thus, the current ramped up from zero to 4.35 milliamps at a substantially uniform rate and the evolution of resistance as a function of dissipated power is shown as the second sweep 107. The second sweep 107 includes a first portion 122, in which resistance continues to drop substantially linearly between the start point 111 and the region generally designated 124. Thus, similarly to the first sweep 103, the second sweep 107 includes a region 122 in which resistance drops substantially linearly.

However as the current increases during the second sweep 107, and hence the dissipated power increases, the resistor continues to warm by Joule heating until the onset of thermal migration as indicated by region 124, in which the slope of the curve starts to drop. Thereafter, the gradient of the curve showing the evolution of resistance with respect to dissipated power moves into a new section 126, which continues on until the end point 128 where the end current value is reached and the increase of current is halted. After the current has peaked at the second sweep end value, the current was subsequently reduced back to zero in a second cycle measurement phase, represented by line 130. It can be seen that the slope of line 130 is substantially horizontal as the current is reduced such that dissipated power drops from 0.08 watts to about zero watts. At the end of the second sweep 130 the resistance of the resistor has been reduced to substantially 4850 ohms and the PCR, which corresponds to the slope of the line 130, has been reduced to substantially zero. Using this approach has the advantage that it is relatively easy to measure the PCR of a resistor, and once a PCR or slope of substantially zero has been achieved, it follows that a temperature coefficient of resistance ("TCR") of substantially zero has also been achieved.

The person skilled in the art will appreciate that having a substantially zero thermal coefficient of resistance can be desirable. However, in some circumstances reduced but non-zero values may be desirable. For example the temperature coefficient of aluminum is approximately 0.0039 per degree Kelvin and therefore it may be desirable for the thin film resistor to maintain a slight negative temperature coefficient in order to counteract the expected positive temperature coefficient of aluminum conductors connecting the thin film resistor to other parts of an integrated circuit and/or the temperature coefficient of components, for example transistors, in circuits associated with the resistors.

Returning to FIG. 2, a third cycle was performed in which the current was increased in a third thermal stressing sweep from zero to a new end point 142, and the evolution of resistance with respect to dissipated power is shown by chain line 140. In this third sweep 140 the current was increased to a maximum value corresponding to turning point 142 corresponding to a current of approximately 4.5 milliamps. The current was then swept back towards zero in a third measurement phase and the resistance as a function of dissipated power is shown by chain region 144 which, as can be seen has a slight positive gradient. The measured resistance of the resistor as the current through it drops to substantially zero is now approximately 4770 ohms. Thus, in this example the resistance of the resistor was reduced or trimmed by approximately 300 ohms, or nearly 6%, as a result of the selective thermal stress applied to it.

The method of trimming illustrated in FIG. 2 can be used to form a resistor having a desired PCR value. For example, to form a resistor having a specific PCR value, a resistor is deposited with a resistance greater than that required, such as about 5% above the desired value. The resistor can then be electrically trimmed as described above to achieve the desired PCR value. Thereafter, the resistor can additionally be trimmed using a laser or any other suitable technique to achieve the desired resistance value. However, as the figures show, it is also possible to sacrifice PCR performance to achieve a desired resistance value without using laser trimming. For example, to produce a 5000 ohms resistor, a resistor may be laid out to have a nominal impedance of, for example, about 5200 ohms. This resistor can then be subjected to a plurality of current induced thermal stressing cycles and subsequent measurement cycles such that the silicon is thermally migrated and the final temperature coefficient of resistance and the final resistance value can be determined and controlled via the thermal cycling of the resistor. In order to have a controllable and repeatable process, the rate at which the current is swept in terms of milliamps per second may be kept constant and the end value of each current sweep may be related to the end value of the preceding current sweep.

Figure 3:
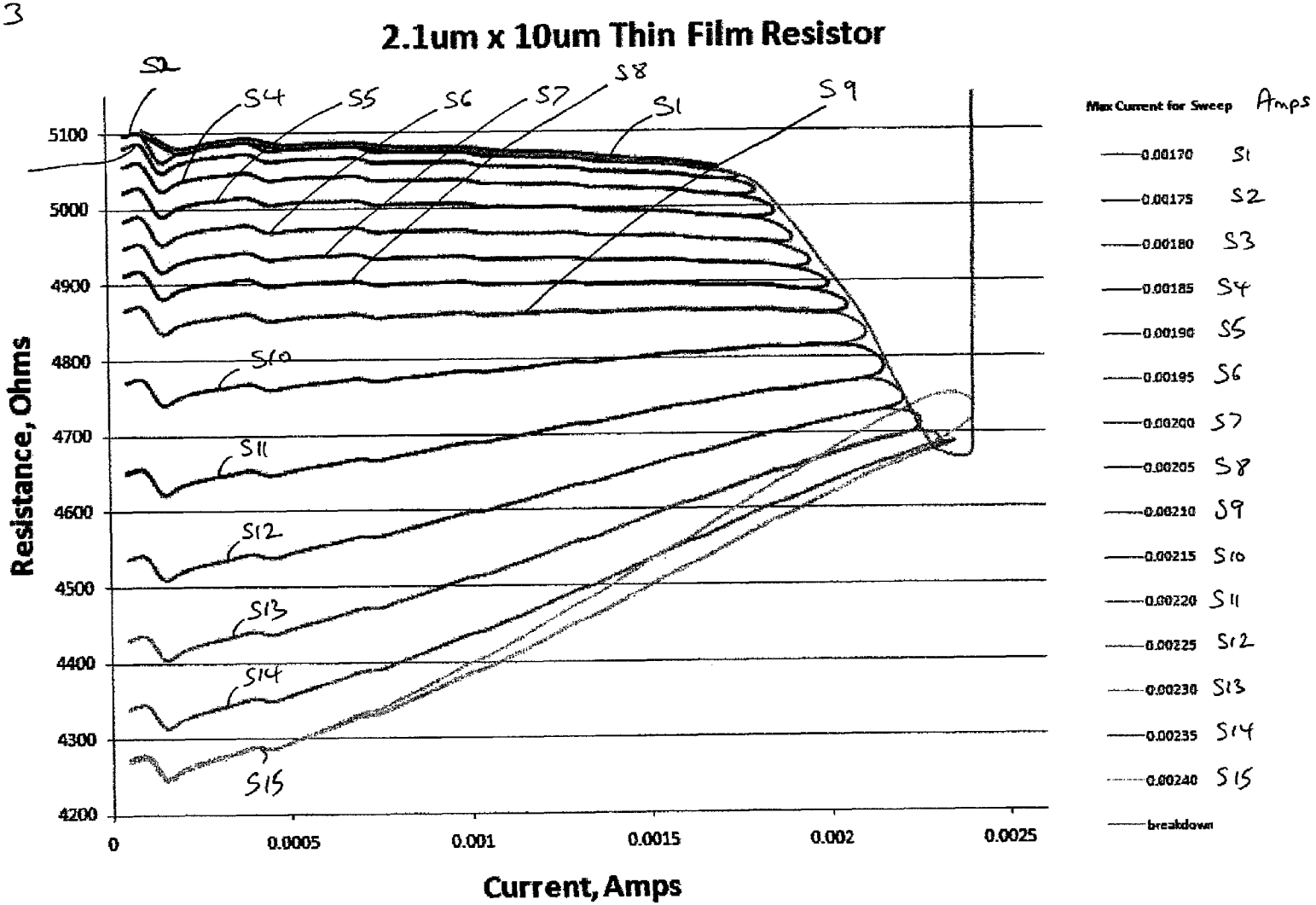
FIG. 3 is a graph showing the evolution of resistance as a function of current for a thermally stressed resistor over multiple current sweeps.

FIG. 3 schematically illustrates the result of multiple current sweeps on a resistor. During a first current sweep labeled S1 the current was swept from substantially zero to a first sweep end value of 1.70 milliamps, and then in a first measurement phase was returned from 1.70 milliamps back to about zero milliamps. The maximum value for the first sweep current can either be determined by a user based on, for example, previous experience of the performance of the thin film resistors, or may be set such that the sweep is halted once the resistance changes by more than a predetermined value, for example by about 0.1%. Alternatively, the maximum value for the first current sweep may be set at a current value below that at which migration commences. Once the first thermal stress sweep has been concluded the current is ramped back down to zero and the resistance is repeatedly measured as the current reduces, thereby completing the first stress and measurement cycle. Following this a second cycle is commenced in which the current in a second sweep, labeled S2 was swept from zero to substantially 1.75 milliamps and then returned. The end current point of the second sweep S2 is greater than the end current point of the first sweep S1. In this Figure the plot of S2 substantially underlies that of S1, which corresponds to a reduction or trimming of resistance of the resistor. In a third measurement cycle measured S3 the current was swept from substantially zero to 1.80 milliamps and then returned. Subsequent cycles were performed with the fourth cycle S4 having a maximum current of 1.85 milliamps, the fifth cycle S5 having a maximum current of 1.90 milliamps, the sixth cycle S6 having a maximum current of 1.95 milliamps and so on. Thus in this example and Nth+1 cycle has a maximum current corresponding to that of the Nth cycle plus an increment, which in this example is 0.05 milliamps. On each cycle the nominal zero current resistance of the resistor has been decreased from that of the preceding cycle, and by the thirteenth cycle the resistance of the resistor has been decreased from about 5100 ohms to approximately about 4330 ohms by the repeated thermal stressing applied to it.

In some instances, resistors can be combined in series or parallel to achieve a composite value having both a substantially zero PCR and a target resistance without relying on laser trimming.

Although FIG. 3 is illustrated for the case of current sweeps, persons of ordinary skill in the art will appreciate that other sweeps are possible to thermally stress the resistor. For example, a voltage sweep can be used, in which the voltage applied to the resistor is increased in steps to thermally stress the resistor. The maximum voltage applied to the resistor can increase from sweep to sweep in any suitable increment.

Figure 4:
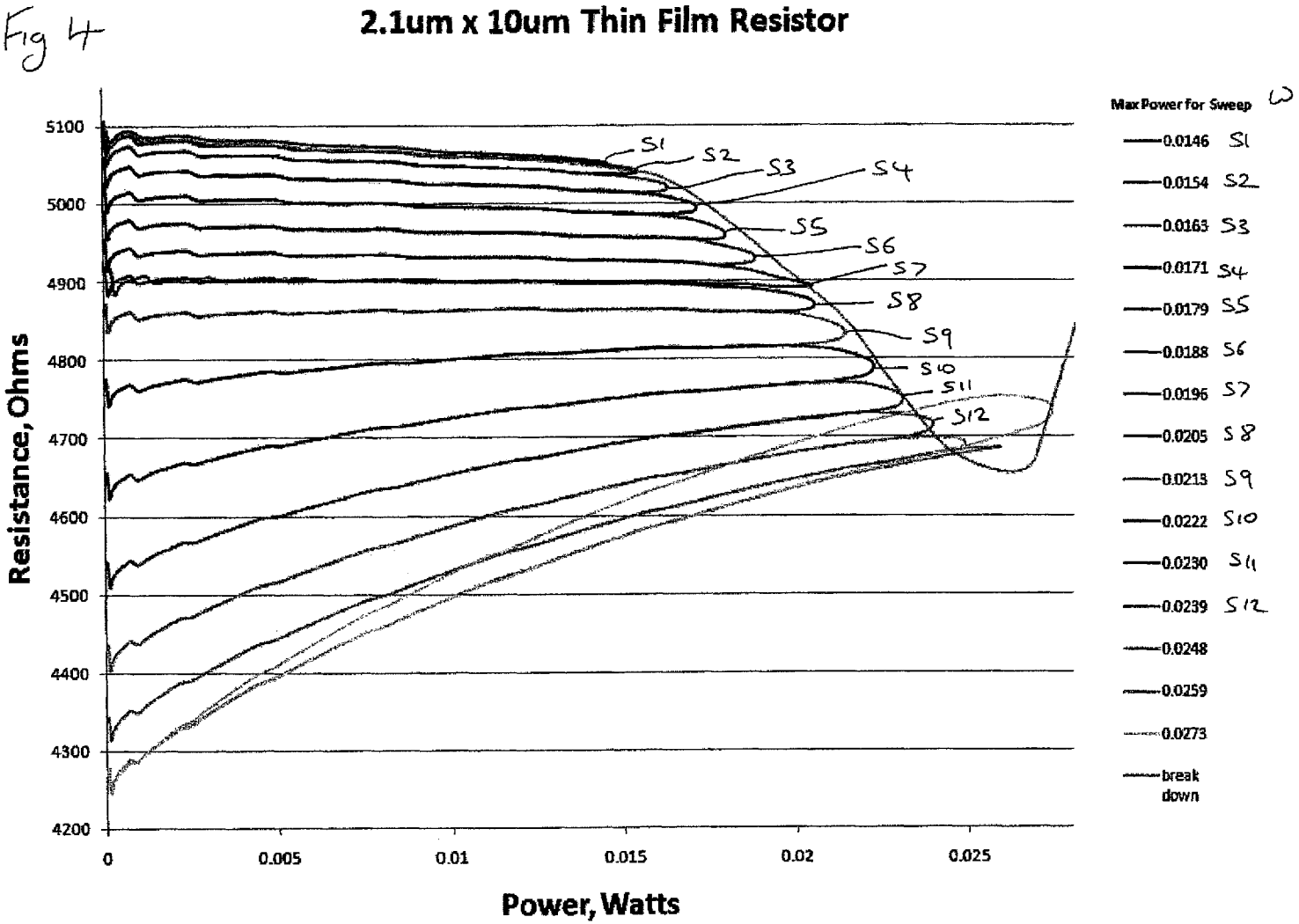
FIG. 4 is a similar graph to that of FIG. 3, but shows the evolution of the resistance as a function of the power dissipated by the resistor over multiple current sweeps.
Figure 5:
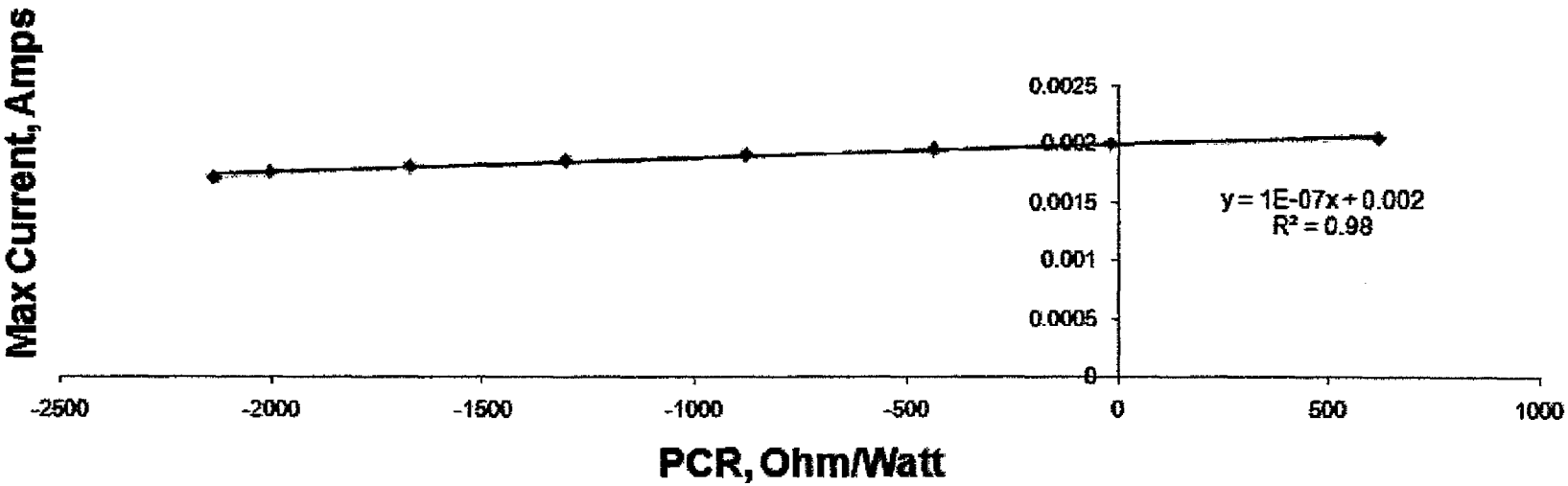
FIG. 5 is a graph showing a relationship between the maximum current and the power coefficient of resistance ("PCR") for a first test resistor.

FIG. 4 shows an equivalent set of data for the same nominal resistor, but this time plotted against dissipated power as opposed to current.

In the example shown in FIGS. 3 and 4, the end current for a cycle was related to the end current of the previous cycle as part of an arithmetic progression. However, this need not be the case and, for example, the end current or rate of current change in an Nth+1 sweep could be modified based on data from an Nth sweep, or indeed other preceding sweeps to aid in achieving a desired PCR value or a desired resistance value for the resistor. Thus, a skilled artisan will appreciate that the resistance values at the end of each measurement sweep corresponding to substantially zero amps, such as the resistance at the points 101 and 111 in FIG. 2, can be plotted against the end current of each measurement cycle and can be used to predict the end current required in a final thermal stressing cycle to achieve a desired resistance. Similarly, as shown in FIG. 5 for a test sample, a relationship can be defined between the maximum current at the end of each current sweep and a power coefficient of resistance ("PCR") of the film. The PCR of a film is a function of the temperature coefficient resistance ("TCR") of the film, and a PCR of about zero corresponds to a TCR of about zero.

Figure 6:
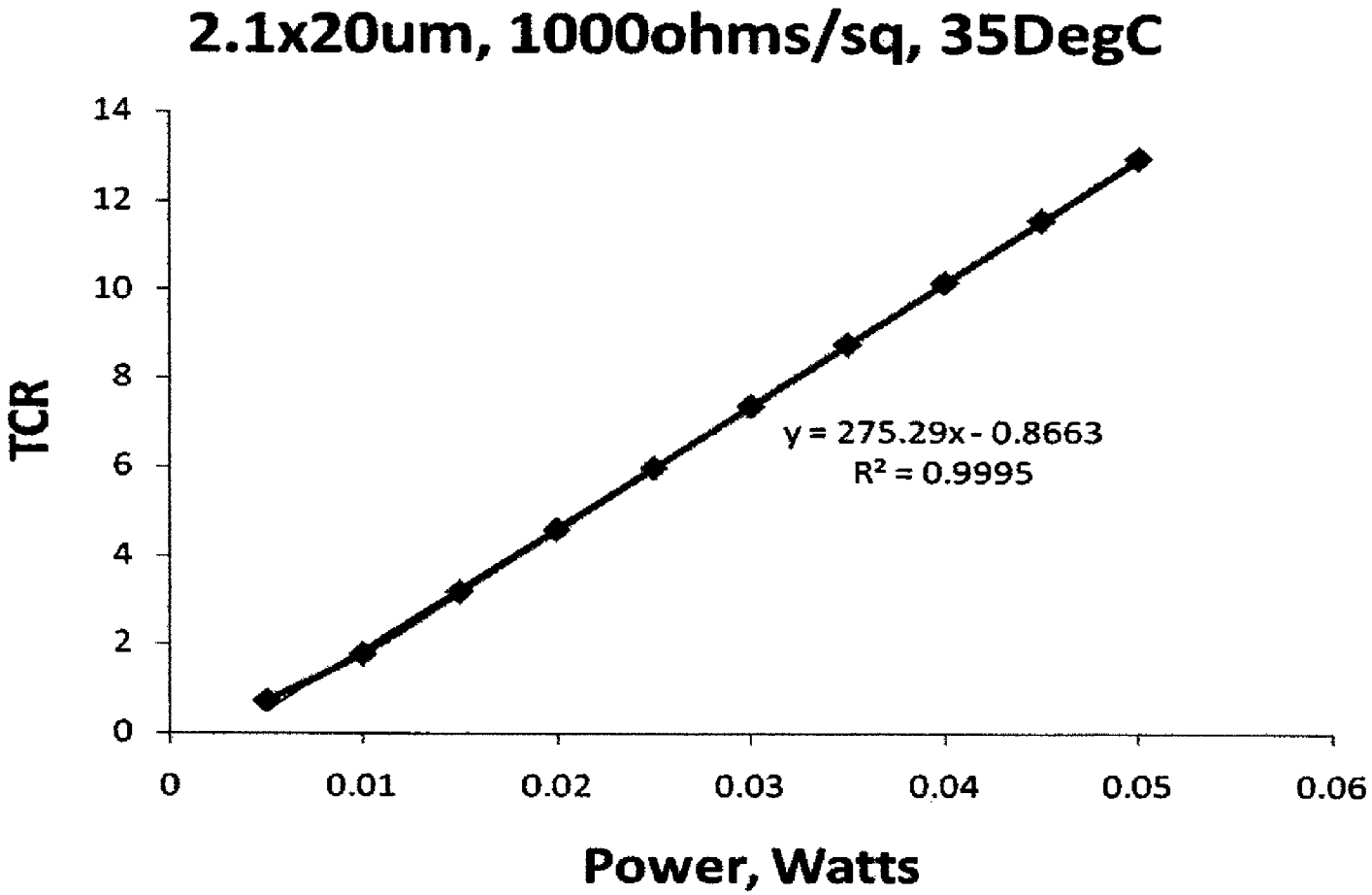
FIG. 6 is a graph showing the temperature coefficient of resistance against power for a resistor under test.

FIG. 6 shows a plot of the temperature coefficient of resistance versus power for a resistor having a width of about 2.1 microns and a length of about 20 microns, and having a unit square resistance of about 1000 ohms. Thus, this resistor has a nominal resistance of about 10 kΩ. It can be seen that, when operating in a region where the resistor does not dissipate more that about 0.02 watts, the TCR is down below about 4 parts per million per degrees C. for a part operating at 35° C. and, when the dissipated power is kept to about 0.005 watts, the temperature coefficient to resistance is approximately 1 part per million per degrees C.

The currents used to heat the resistor may be regulated by transistors internal to the device, such as when external connections to the resistor are not made. It may therefore be desirable to seek to reduce the current to be passed. This may for example be achieved, by promoting self-heating by moving the thin film resistor further up the integrated circuit stack, thereby increasing an amount of oxide between the silicon chromium resistor and a semiconductor substrate. This increases the thermal resistance between the resistor and the semiconductor substrate, and therefore promotes more self heating. A further approach may be to fabricate a metal heater below the resistor, which could also have the effect of operating as a thermal barrier between the resistor and the silicon substrate.

It is thus possible to provide a simple and reliable way of altering the electrical properties of thin film resistors, including PCR, TCR and resistance. The sweep method described herein has the advantage of being substantially process independent and always tending towards a correct value. However, based on knowledge, or mathematical modeling of the properties of a given integrated circuit and process, it is possible to apply a trimming current in a single pass, having calculated or previously determined by experiment the maximum current value and current duration and/or sweep rate required to achieve the target electrical property. Furthermore the process can be modified to take account of ambient temperature or external heating using, for example, mathematical modeling or empirical experimentation.

Although the invention has been described with respect to silicon-chromium resistors, it may be used with other resistor technologies such as Polysilicon resistors, Ni-chrome resistors, aluminum resistors and so on.

Devices employing the above described resistor trimming schemes can be implemented into various electronic devices. Examples of the electronic devices can include, but are not limited to, consumer electronic products, parts of the consumer electronic products, electronic test equipment, etc. Examples of the electronic devices can also include memory chips, memory modules, circuits of optical networks or other communication networks, and disk driver circuits. The consumer electronic products can include, but are not limited to, a mobile phone, a telephone, a television, a computer monitor, a computer, a hand-held computer, a personal digital assistant (PDA), a microwave, a refrigerator, an automobile, a stereo system, a cassette recorder or player, a DVD player, a CD player, a VCR, an MP3 player, a radio, a camcorder, a camera, a digital camera, a portable memory chip, a washer, a dryer, a washer/dryer, a copier, a facsimile machine, a scanner, a multi functional peripheral device, a wrist watch, a clock, etc. Further, the electronic device can include unfinished products.

Although this invention has been described in terms of certain embodiments, other embodiments that are apparent to those of ordinary skill in the art, including embodiments that do not provide all of the features and advantages set forth herein, are also within the scope of this invention. Moreover, the various embodiments described above can be combined to provide further embodiments. In addition, certain features shown in the context of one embodiment can be incorporated into other embodiments as well. Accordingly, the scope of the present invention is defined only by reference to the appended claims.

What is claimed is:

1. A method of trimming a thin film resistor, the method comprising:

applying a first current to the resistor so as to alter the power coefficient of resistance (PCR) of the resistor and the resistance of the resistor;

measuring the PCR of the resistor;

and repeatedly applying a current to the resistor and measuring the PCR of the resistor until the PCR of the resistor is substantially equal to a predetermined value.

2. A method as claimed in claim 1, wherein the first current is applied so as to induce a thermally driven change in the resistor.

3. A method as claimed in claim 2, wherein the first current is swept from a start current value so as to increase in magnitude up to an end current value.

4. A method as claimed in claim 3, wherein a plurality of current sweeps are performed, and an end current value of a N+1th sweep corresponds to the end current value of a Nth sweep.

5. A method as claimed in claim 4, wherein the end current value of an N+1 th sweep is arithmetically related to the end current value of a Nth sweep.

6. A method as claimed in claim 4, wherein the end current value of a N+1 th sweep is equal to the sum of the end current value of a Nth sweep plus a step size value.

7. A method as claimed in claim 3, wherein the current is increased from the start current value to the end current value in a monotonic manner.

8. A method as claimed in claim 3 wherein a rate of change of resistance is monitored during the sweep to identify an onset of the thermally driven change, and the power supplied to the resistor is controlled in magnitude and time so as vary the power coefficient of resistance of the resistor.

9. A method as claimed in claim 3, wherein the current is swept from a current having an amplitude of substantially zero amperes.

10. A method as claimed in claim 1, wherein an additional property of the resistor is selected from a list comprising:

the resistance of the resistor under substantially zero current conditions;

the resistance of the resistor at a given current;

the resistance of the resistor at a given power dissipation;

the resistance of the resistor at a given operating temperature; and the thermal coefficient of the resistance of the resistor.

11. A method as claimed in claim 1, wherein the resistance of the resistor as a function of power dissipated by the resistor is measured by sweeping a second current from a measurement start value to a measurement end value.

12. A method as claimed in claim 11, wherein the current is swept so as to reduce its magnitude and multiple measurements of voltage across the resistor are made.

13. A method as claimed in claim 1, wherein the resistor is a silicon-chromium thin film resistor.

14. A method as claimed in claim 1, wherein the PCR is trimmed and in a subsequent step the resistor is laser trimmed to modify its resistance.

15. A method as claimed in claim 1, wherein multiple measurements of resistance versus power are made while the current applied to the resistor is increasing in magnitude.

16. A method as claimed in claim 1, wherein multiple measurements of resistance versus power are made while the current applied to the resistor is decreasing in magnitude.

17. An integrated circuit including at least one resistor, the integrated circuit including connection paths to the resistor to enable the resistor to be trimmed in accordance with the method of claim 1.

18. An integrated circuit as claimed in claim 17, further comprising a controllable current source operable to thermally stress a thin film resistor within the integrated circuit.

19. A method as claimed in claim 1 wherein two resistors of opposite PCR polarity are placed in series or parallel to produce a 0 PCR resistor, and wherein the resistor values are selected to produce a specific resistance.

* * * * *